US008784042B2

(12) United States Patent
Clemen

(10) Patent No.: US 8,784,042 B2
(45) Date of Patent: Jul. 22, 2014

(54) FAN DOWNSTREAM GUIDE VANES OF A TURBOFAN ENGINE

(75) Inventor: Carsten Clemen, Mittenwalde (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 588 days.

(21) Appl. No.: 13/180,110

(22) Filed: Jul. 11, 2011

(65) Prior Publication Data

US 2012/0014780 A1 Jan. 19, 2012

(30) Foreign Application Priority Data

Jul. 19, 2010 (DE) ..... 10 2010 027 588

(51) Int. Cl.
*F01D 1/04* (2006.01)

(52) U.S. Cl.
USPC ..... 415/144; 415/211.2

(58) Field of Classification Search
USPC ..... 415/144, 191, 192, 208.1, 208.2, 211.2; 416/223 A, 24, DIG. 2, DIG. 5
See application file for complete search history.

(56) References Cited

U.S. PATENT DOCUMENTS

| | | | | |
|---|---|---|---|---|
| 5,259,187 | A | 11/1993 | Dunbar | |
| 7,416,382 | B2 * | 8/2008 | Guemmer | 415/160 |
| 7,419,353 | B2 * | 9/2008 | Guemmer | 415/191 |
| 2007/0140837 | A1 * | 6/2007 | Guemmer | 415/160 |
| 2009/0226322 | A1 | 9/2009 | Clemen | |
| 2011/0016883 | A1 | 1/2011 | Clemen | |

FOREIGN PATENT DOCUMENTS

| | | |
|---|---|---|
| DE | 69414733 | 6/1999 |
| DE | 102006055869 | 5/2008 |
| DE | 102009034530 | 1/2011 |
| EP | 0943784 | 9/1999 |
| EP | 1956247 | 8/2008 |
| EP | 2239420 | 10/2010 |
| WO | 2010/002294 | 1/2010 |

OTHER PUBLICATIONS

German Search Report dated Apr. 5, 2011 from counterpart application.

* cited by examiner

*Primary Examiner* — Edward Look
*Assistant Examiner* — Aaron R Eastman
(74) *Attorney, Agent, or Firm* — Timothy J. Klima; Shuttleworth & Ingersoll, PLC

(57) ABSTRACT

Fan downstream guide vane profiles have an optimized form of skeleton line angle distribution in an area situated between an upper and a lower limitation as well as a specific thickness distribution superimposed on the respective skeleton line angle distribution. Such guide vanes are characterized by lower pressure losses and a larger working range than the known downstream guide vanes, thereby reducing fuel consumption of the engine and increasing the operating stability thereof.

11 Claims, 1 Drawing Sheet

FAN DOWNSTREAM GUIDE VANES OF A TURBOFAN ENGINE

Figure 1:
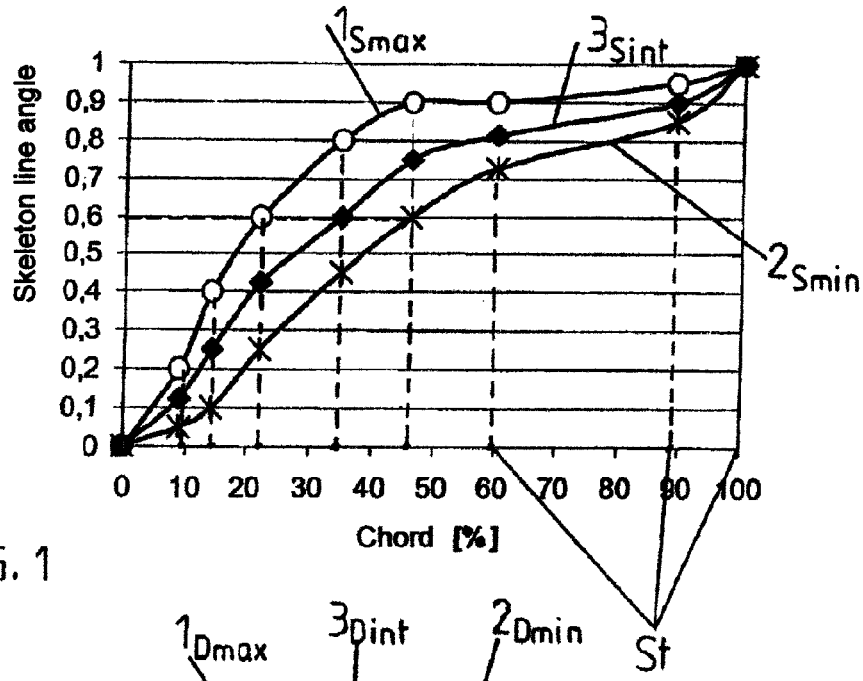

This application claims priority to German Patent Application DE102010027588.3 filed Jul. 19, 2010, the entirety of which is incorporated by reference herein.

This invention relates to fan downstream guide vanes for a turbofan engine which extend in one vane height between an inner and an outer sidewall in the bypass duct and whose shape is established by a plurality of aerodynamic profiles radially stacked on top of each other and determined by a skeleton line angle distribution with appertaining, superimposed thickness distribution over a chord length.

On a turbofan engine, downstream guide vanes are arranged downstream of the fan in the bypass duct in circumferentially equal distribution to deswirl the airflow in the bypass duct. The shape of the downstream guide vanes is established by a plurality of aerodynamically favorable profiles representing a horizontal section of the downstream guide vane and being radially stacked on top of each other. All downstream guide vanes arranged circumferentially in the bypass duct have the same maximum profile thickness and the same axial length, i.e. a corresponding chord length extending from the vane leading edge to the vane trailing edge.

The profile of the downstream guide vanes is determined by its skeleton line and a thickness distribution superimposed on the skeleton line. The thickness distribution is defined as the course of the dimensionless thickness over the dimensionless chord length (0 to 100 percent), with the thickness being made dimensionless with the maximum profile thickness.

The skeleton line is described as the course of the dimensionless skeleton line angle distribution along the chord length. The respective skeleton line angle $\alpha$ over the chord length results from:

$$\alpha(l)=(\alpha i(l)-BIA)/(BOA-BIA)[\%],$$

with $\alpha i$ being the local angle of the skeleton line, BIA being the inlet angle and BOA the outlet angle, each measured relatively to the engine axis.

The profile of the downstream guide vanes finally results from the addition of each half of the thickness on each side of the skeleton line.

The hitherto known profiles—determined by the combination of skeleton line distributions and thickness distributions—are not optimally conceived in that, when they are flown in the bypass duct, neither the lowest profile pressure loss nor the maximum possible working range are ensured, as a result of which engine operating stability is reduced and fuel consumption increased.

In a broad aspect, the present invention provides for a design of the profile of fan downstream guide vanes such that pressure losses are minimized and eventually fuel consumption is reduced.

It is a particular object of the present invention to provide solution to the above problems by a vane profile designed in accordance with the features described herein, which is variable within an upper and a lower limitation.

Advantageous developments and embodiments of the present invention will also be apparent from the present description.

The present invention, in essence, provides for a novel, optimized form of the skeleton line angle distribution in an area situated between an upper and a lower limitation, as well as a specific thickness distribution superimposed on the respective skeleton line angle distribution to provide fan downstream guide vane profiles characterized by lower pressure losses and a larger working range than the known downstream guide vanes, thereby reducing the fuel consumption of the engine and increasing the operating stability thereof.

The novel vane profiling includes an upper and a lower profile forming an upper and a lower limitation determined by specified supporting points along the chord at 0, 9, 14, 22, 35, 46, 60, 89 and 100% respectively assigned dimensionless values of an upper skeleton line angle of 0, 0.2, 0.4, 0.6, 0.8, 0.9, 0.9, 0.95 and 1 and an upper thickness of 0, 0.85, 0.95, 1, 0.95, 0.875, 0.7, 0.2 and 0 as upper limitation of the skeleton line angle distribution and the thickness distribution as well as a lower skeleton line angle of 0, 0.05, 0.1, 0.25, 0.45, 0.6, 0.725, 0.85 and 1 and a lower thickness of 0, 0.4, 0.55, 0.75, 0.95, 1, 0.9, 0.35, and 0 as lower limitation of the skeleton line angle distribution and the thickness distribution. The novel vane profiling further includes a majority of intermediate profiles situated between the upper and the lower limitation and determined by interpolation at the specified supporting points.

When determining the profiles of the upper and the lower limitation, the thickness distribution is related to the respective skeleton line angle distribution in such a manner that the respective supporting point with the appertaining maximum value of the thickness distribution in each case corresponds to the supporting point (St) at which the skeleton line angle distribution of the upper and the lower limitation has the value 0.6.

In a further development of the present invention, the intermediate profiles situated between the profiles of the upper and the lower limitation are the result of an interpolated skeleton line angle distribution and an interpolated thickness distribution and the superposition thereof. Interpolation is made at the specified supporting points between the respective value of the upper and the lower limitation. The supporting point along the chord is determined with the appertaining value 0.6 of the skeleton line angle distribution by linear interpolation between the 0.6 values of the skeleton line angle distribution of the upper and the lower limitation.

In development of the present invention, the profiles of the upper limitation are provided in the mid of the vane height or, respectively, the bypass duct, and the profiles of the lower limitation are provided at the upper and the lower sidewall of the bypass duct, while interpolated intermediate profiles are provided in the intermediate areas situated between the profiles of the upper and the lower limitation.

In principle, the profiles of the upper and/or lower limitation and/or the interpolated intermediate profiles can however be provided at any vane height.

The present invention is more fully described in light of the accompanying drawings showing an exemplary embodiment. In the drawings, FIG. 1 shows the course of the skeleton line angle over a profile chord (skeleton line angle distribution) in an upper and a lower limitation curve as well as of a skeleton line angle distribution for one profile shape each interpolated by way of example between these limitation curves.

Figure 2:
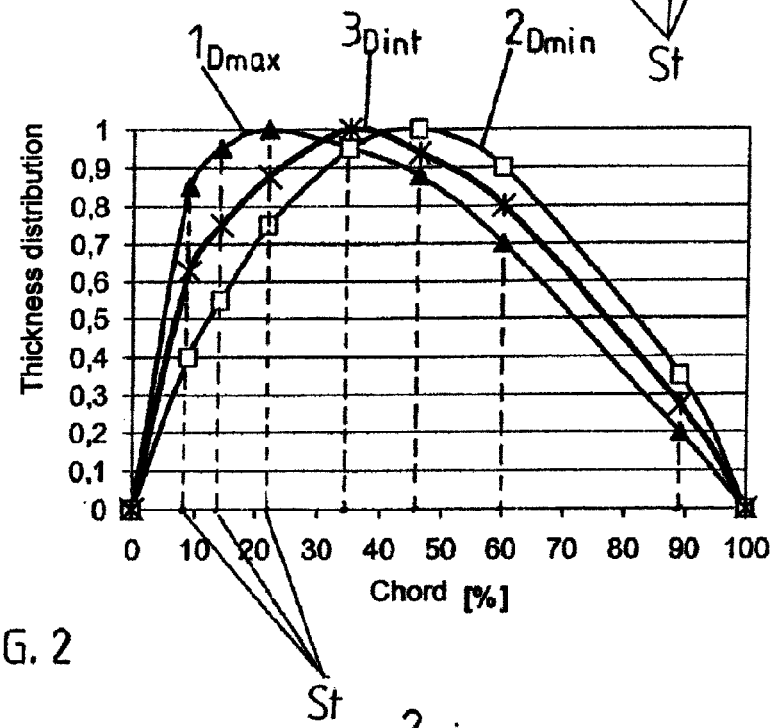
Figure 3:
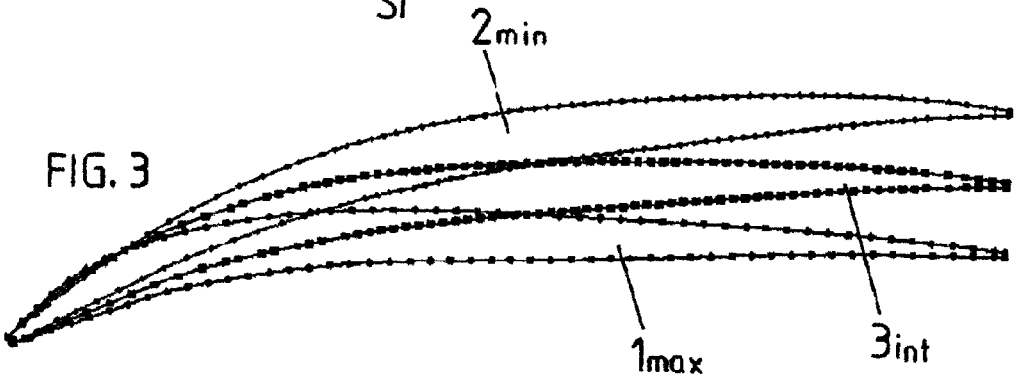

FIG. 2 shows the course of the thickness over a profile chord (thickness distribution) as upper and lower limitation as well as a thickness course interpolated between the upper and the lower limitation, and FIG. 3 shows three downstream guide vane profiles resulting from the combination of the respective skeleton line angle distribution with the respectively appertaining thickness distribution according to FIGS. 1 and 2.

FIG. 1 shows, on the curve designated $\mathbf{1}_{Smax}$, the upper limitation of the skeleton line angle distribution and, on the curve designated $\mathbf{2}_{smin}$, the lower limitation of the skeleton line angle distribution for the optimum design of downstream guide vane profiles arranged in the bypass duct of a turbofan engine. In FIG. 2, the upper and the lower limitation of the thickness distribution are indicated by $\mathbf{1}_{Dmax}$ or $\mathbf{2}_{Dmin}$, respectively. The skeleton line angle and the thickness of the profile which—as specified above—are each made dimensionless, are plotted over the also dimensionless profile chord. The supporting points St along the profile chord for indicating the amount of the skeleton line angle or, respectively, the thickness are at 0, 9, 14, 22, 35, 46, 60, 89 and 100% for all skeleton line angle and thickness distributions. The skeleton line angles $\alpha l_o$, $\alpha l_u$ and the profile thicknesses $d_o$, $d_u$ assigned to the respective supporting points St for the upper and the lower limitation of the skeleton line distribution or, respectively, the thickness distribution $\mathbf{1}_{Smax}$, $\mathbf{1}_{Dmax}$, $\mathbf{2}_{Smin}$, $\mathbf{2}_{Dmin}$ and the corresponding profiles are shown in the following table:

| | $1_{Smax}$ $1_{Dmax}$ upper limitation | | $2_{Smin}$ $2_{Dmin}$ lower limitation | |
|---|---|---|---|---|
| St | $\alpha 1_o$ | $d_o$ | $\alpha 1_u$ | $d_u$ |
| 0 | 0 | 0 | 0 | 0 |
| 9 | 0.2 | 0.85 | 0.05 | 0.4 |
| 14 | 0.4 | 0.95 | 0.1 | 0.55 |
| 22 | 0.6 | 1 | 0.25 | 0.75 |
| 35 | 0.8 | 0.95 | 0.45 | 0.95 |
| 46 | 0.9 | 0.875 | 0.6 | 1 |
| 60 | 0.9 | 0.7 | 0.725 | 0.9 |
| 89 | 0.95 | 0.2 | 0.85 | 0.35 |
| 100 | 1 | 0 | 1 | 0 |

As shown in FIG. 2 and the tabulation of the skeleton line angles and profile thicknesses assigned to the supporting points St, the thickness distribution reaches its maximum on the upper and lower limiting curve thereof at the supporting points 22 percent and 46 percent of the profile chord, i.e. at the same supporting points at which the skeleton line angle of the upper and the lower limiting curve concurrently has the value 0.6. Thus, a definite relation is established between the thickness distribution and the skeleton line angle distribution. Between the supporting points St, the course of the skeleton line distribution and the thickness distribution is continuous.

Superposition of the upper limiting curves of the skeleton line and thickness distribution $\mathbf{1}_{Smax}$ and $\mathbf{1}_{Dmax}$ and the lower limiting curves of the skeleton line and thickness distribution $\mathbf{2}_{Smin}$ and $\mathbf{2}_{Dmin}$ results in the—upper and lower—profiles $\mathbf{1}_{max}$ (upper limitation) and $\mathbf{2}_{min}$ (lower limitation) of fan downstream guide vanes shown in FIG. 3. The profiles defined in mutual dependence of optimum skeleton line distribution and optimum thickness distribution have a lower pressure loss and a larger working range than conventional ones.

By linear interpolation between the upper and lower limiting curves of the skeleton line distribution and the thickness distribution $\mathbf{1}_{Smax}$ and $\mathbf{1}_{Smin}$ as well as $\mathbf{1}_{Dmax}$ and $\mathbf{1}_{Dmin}$, further curves of an interpolated skeleton line and thickness distribution are obtained between the two upper and lower profiles $\mathbf{1}_{max}$ (upper limitation) and $\mathbf{2}_{min}$ (lower limitation), here for example $\mathbf{3}_{Sint}$ and $\mathbf{3}_{Dint}$ (see FIGS. 1 and 2), whose superposition results in further intermediate profiles situated between the profiles $\mathbf{1}_{max}$ and $\mathbf{2}_{min}$, here the intermediate profile $\mathbf{3}_{int}$.

Interpolation is made at each of the supporting points of the chord specified above as per the equation:

$$\text{Interpolated value}=\text{lower value}+(\text{upper value}-\text{lower value})\cdot x,$$

with x being a factor ranging between 0 and 1.

By means of the following equation:

$$\text{Position chord length [\%]}=22+(0.6\ \text{value skeleton line angle at 22\%})/[\text{value skeleton line angle at 46\%}-\text{value skeleton line angle at 22\%})/24]$$

the position along the profile chord at which the value of the skeleton line angle distribution is 0.6 is calculated by interpolation between the values at 22% and 46% of the chord length. In this position, the value of the thickness distribution is just 1.

The upper and lower profiles and the intermediate profiles so defined can be provided at any vane section along the vane height. Preferably, the upper profile $\mathbf{1}_{max}$ will however be situated in vane mid and the lower profile $\mathbf{2}_{min}$ at the inner and outer sidewall of the bypass duct, while an interpolated intermediate profile $\mathbf{3}_{int}$ is situated between the inner or the outer sidewall, respectively, and the vane mid.

LIST OF REFERENCE NUMERALS $\mathbf{1}_{Smax}$ Skeleton line angle distribution—upper limitation
$\mathbf{2}_{Smin}$ Skeleton line angle distribution—lower limitation
$\mathbf{3}_{Sint}$ Interpolated skeleton line angle distribution
$\mathbf{1}_{Dmax}$ Thickness distribution—upper limitation
$\mathbf{2}_{Dmin}$ Thickness distribution—lower limitation
$\mathbf{3}_{Dint}$ Interpolated thickness distribution
St Supporting points along the profile chord
$\mathbf{1}_{max}$ Profile downstream guide vane—upper limitation
$\mathbf{2}_{min}$ Profile downstream guide vane—lower limitation
$\mathbf{3}_{int}$ Intermediate profile—interpolated between $\mathbf{1}_{max}$ and $\mathbf{2}_{min}$
$\alpha l_o$ Skeleton line angle—upper limitation
$\alpha l_u$ Skeleton line angle—lower limitation
$d_o$ Thickness—upper limitation
$d_u$ Thickness—lower limitation

What is claimed is:

1. Fan downstream guide vanes for a turbofan engine, comprising:

the downstream guide vanes extending in one vane height between an inner and an outer sidewall in a bypass duct of the turbofan engine and whose shape is established by a plurality of aerodynamic profiles radially stacked on top of each other and determined by a skeleton line angle distribution with an appertaining, superimposed thickness distribution over a chord length an upper and a lower profile ($\mathbf{1}_{max}$, $\mathbf{2}_{min}$) forming an upper limitation and a lower limitation determined by specified supporting points (St) of chord lengths of 0, 9, 14, 22, 35, 46, 60, 89 and 100%, respectively having:

dimensionless values of a skeleton line angle ($\alpha l_o$) of 0, 0.2, 0.4, 0.6, 0.8, 0.9, 0.9, 0.95 and 1 and a thickness ($d_o$) of 0, 0.85, 0.95, 1, 0.95, 0.875, 0.7, 0.2 and 0 as the upper limitation of a skeleton line angle distribution and a thickness distribution ($\mathbf{1}_{Smax}$, $\mathbf{1}_{Dmax}$);

a skeleton line angle ($\alpha l_u$) of 0, 0.05, 0.1, 0.25, 0.45, 0.6, 0.725, 0.85 and 1 and a thickness ($d_u$) of 0, 0.4, 0.55, 0.75, 0.95, 1, 0.9, 0.35, and 0 as the lower limitation of the skeleton line angle distribution and the thickness distribution ($\mathbf{2}_{Smax}$, $\mathbf{2}_{Dmax}$); and a plurality of intermediate profiles ($\mathbf{3}_{int}$) situated between the upper and the lower limitations.

2. The fan downstream guide vanes of claim 1, wherein the thickness distribution ($\mathbf{1}_{Dmax}$, $\mathbf{2}_{Dmin}$) is related to the respective skeleton line angle distribution ($\mathbf{1}_{Smax}$, $\mathbf{2}_{Smin}$) such that a respective supporting point (St) with an appertaining maximum value of the thickness distribution ($\mathbf{1}_{Dmax}$, $\mathbf{2}_{Dmin}$) in each case corresponds to a supporting point (St) at which the skeleton line angle distribution ($\mathbf{1}_{Smax}$, $\mathbf{2}_{Smin}$) has the value 0.6.

3. The fan downstream guide vanes of claim 2, wherein the intermediate profiles ($\mathbf{3}_{int}$) situated between the profiles of the upper and the lower limitation ($\mathbf{1}_{max}$, $\mathbf{2}_{min}$) result from an interpolated skeleton line angle distribution ($\mathbf{3}_{Sint}$) and an interpolated thickness distribution ($\mathbf{3}_{Dint}$) and a superposition thereof, with the interpolation being made at the specified supporting points (St) between the respective value of the upper and the lower limitation, and with the supporting point (St) being determined with the appertaining value 0.6 of the skeleton line angle distribution by linear interpolation between the 0.6 values of the skeleton line angle distribution of the upper and the lower limitation ($\mathbf{1}_{Smax}$, $\mathbf{2}_{Smin}$).

4. The fan downstream guide vanes of claim 3, wherein the profiles of the upper limitation ($\mathbf{1}_{max}$) are provided at at least one of a mid of the vane height and the bypass duct, respectively, and that the profiles of the lower limitation ($\mathbf{2}_{min}$) are provided at the inner and the outer sidewalls of the bypass duct, while the intermediate profile ($\mathbf{3}_{int}$) interpolated between the profiles ($\mathbf{1}_{max}$ and $\mathbf{2}_{min}$) is provided at 25% and 75% of the vane height.

5. The fan downstream guide vanes of claim 4, wherein the profiles of at least one of the upper limitation ($\mathbf{1}_{max}$), the lower limitation ($\mathbf{2}_{min}$) and the interpolated intermediate profiles ($\mathbf{3}_{int}$) are provided at any vane height.

6. The fan downstream guide vanes of claim 1, wherein the intermediate profiles ($\mathbf{3}_{int}$) situated between the profiles of the upper and the lower limitation ($\mathbf{1}_{max}$, $\mathbf{2}_{min}$) result from an interpolated skeleton line angle distribution ($\mathbf{3}_{Sint}$) and an interpolated thickness distribution ($\mathbf{3}_{Dint}$) and a superposition thereof, with the interpolation being made at the specified supporting points (St) between the respective value of the upper and the lower limitation, and with the supporting point (St) being determined with the appertaining value 0.6 of the skeleton line angle distribution by linear interpolation between the 0.6 values of the skeleton line angle distribution of the upper and the lower limitation ($\mathbf{1}_{Smax}$, $\mathbf{2}_{Smin}$).

7. The fan downstream guide vanes of claim 6, wherein the profiles of the upper limitation ($\mathbf{1}_{max}$) are provided at at least one of a mid of the vane height and the bypass duct, respectively, and that the profiles of the lower limitation ($\mathbf{2}_{min}$) are provided at the inner and the outer sidewalls of the bypass duct, while the intermediate profile ($\mathbf{3}_{int}$) interpolated between the profiles ($\mathbf{1}_{max}$ and $\mathbf{2}_{min}$) is provided at 25% and 75% of the vane height.

8. The fan downstream guide vanes of claim 7, wherein the profiles of at least one of the upper limitation ($\mathbf{1}_{max}$), the lower limitation ($\mathbf{2}_{min}$) and the interpolated intermediate profiles ($\mathbf{3}_{int}$) are provided at any vane height.

9. The fan downstream guide vanes of claim 1, wherein the profiles of the upper limitation ($\mathbf{1}_{max}$) are provided at at least one of a mid of the vane height and the bypass duct, respectively, and that the profiles of the lower limitation ($\mathbf{2}_{min}$) are provided at the inner and the outer sidewalls of the bypass duct, while the intermediate profile ($\mathbf{3}_{int}$) interpolated between the profiles ($\mathbf{1}_{max}$ and $\mathbf{2}_{min}$) is provided at 25% and 75% of the vane height.

10. The fan downstream guide vanes of claim 9, wherein the profiles of at least one of the upper limitation ($\mathbf{1}_{max}$), the lower limitation ($\mathbf{2}_{min}$) and the interpolated intermediate profiles ($\mathbf{3}_{int}$) are provided at any vane height.

11. The fan downstream guide vanes of claim 1, wherein the profiles of at least one of the upper limitation ($\mathbf{1}_{max}$), the lower limitation ($\mathbf{2}_{min}$) and the intermediate profiles ($\mathbf{3}_{int}$) are provided at any vane height.

* * * * *